US006791040B1

(12) United States Patent
Puhalla et al.

(10) Patent No.: US 6,791,040 B1
(45) Date of Patent: Sep. 14, 2004

(54) LOCKING ASSEMBLY FOR AN ELECTRICAL SWITCHING APPARATUS

(75) Inventors: Craig J. Puhalla, Moon Township, PA (US); David C. Turner, Imperial, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/662,655

(22) Filed: Sep. 15, 2003

(51) Int. Cl.[7] ..... H01H 9/28
(52) U.S. Cl. ..... 200/43.14
(58) Field of Search ..... 200/43.01–43.22, 200/329–339

(56) References Cited

U.S. PATENT DOCUMENTS 2,849,552 A 8/1958 Firestone
3,214,530 A 10/1965 Tharp et al.
3,408,466 A 10/1968 Palmer
4,260,861 A * 4/1981 DiMarco ..... 200/43.15
4,347,412 A 8/1982 Mihara et al.
4,882,456 A * 11/1989 Hovanic et al. ..... 200/43.15
5,147,991 A 9/1992 Jordan, Sr.
5,219,070 A 6/1993 Grunert et al.
5,310,969 A 5/1994 Turek et al.
5,341,191 A * 8/1994 Crookston et al. ..... 335/16
5,412,167 A 5/1995 Mueller et al.
5,500,495 A 3/1996 Benda et al.
5,577,599 A 11/1996 Turek et al.
5,732,815 A 3/1998 Brouwer

* cited by examiner

*Primary Examiner*—James R. Scott
(74) *Attorney, Agent, or Firm*—Martin J Moran

(57) ABSTRACT

A locking assembly is for a circuit breaker. The circuit breaker includes a housing enclosing separable contacts and an operating mechanism. The housing has an elevated portion with an opening. An operating handle, which operates to open and close the separable contacts, protrudes from the opening and moves between "on" and "off" circuit breaker positions. The locking assembly includes first and second locking elements pivotally connected to the operating handle and structured to engage the elevated portion of the circuit breaker housing, in order to restrain movement of the operating handle from either the "on" or "off" position when the shackle of a lock is inserted through shackle-receiving apertures of the first and second locking elements.

23 Claims, 5 Drawing Sheets

LOCKING ASSEMBLY FOR AN ELECTRICAL SWITCHING APPARATUS

BACKGROUND OF THE INVENTION

1. Field of the Invention

The present invention relates generally to electrical switching apparatus and, more particularly, to a locking assembly for the operating handle of a circuit breaker.

2. Background Information

Electrical switching apparatus include, for example, circuit switching devices and circuit interrupters such as circuit breakers, contactors, motor starters, motor controllers and other load controllers.

Circuit breakers are generally old and well known in the art. An example of a circuit breaker is disclosed in U.S. Pat. No. 5,341,191. Circuit breakers are used to protect electrical circuitry from damage due to an overcurrent condition, such as an overload condition or a relatively high level short circuit or fault condition. Molded case circuit breakers, for example, include at least one pair of separable contacts which are operated either manually by way of a handle disposed on the outside of the case or automatically by way of an internal trip unit in response to an overcurrent condition.

Circuit breakers typically have two or three possible operating handle positions, corresponding to the status of the separable contacts. For example, these positions may include an ON position, in which the separable contacts are closed, an OFF position in which the contacts are open, and a tripped position in which the contacts are tripped open. Typically, the handle position corresponding to the tripped position of the contacts is in between the ON and OFF positions.

In circuit breaker installations, for example in a panel board or load center, it is often desirable or essential that the settings of a single circuit breaker, or a group of circuit breakers, remain undisturbed. Unauthorized or inadvertent changing of the position of these breakers could result in annoying interruptions to service or operations, serious damage to an electrical apparatus, or even serious harm to a person. For example, accidental actuation of a circuit breaker might result in electrocution or shock to a workman performing electrical work or repair within an office building or home. Therefore, to prevent, for example, another person from inadvertently returning the circuit breaker handle to the ON position when a worker is doing electrical work in an area other than the immediate vicinity of the circuit breaker box or electrical panel, safety measures must be taken. One such safety measure is the addition of a locking assembly to prevent displacement of the circuit breaker handle.

Although the main purpose of a circuit breaker is to trip during overload or short circuit conditions in order to protect downstream equipment and electrical wiring from damage, it may also be highly desirable to inhibit the circuit interruption function under certain conditions where, for example, the potential fire hazard of a non-opening circuit breaker is deemed to be a lesser hazard than if current flow to downstream devices is interrupted. The decision to accept the risk of fire over some other hazardous consequence may occur during emergencies or other critical situations where loss of life might occur if power is disrupted. Conceivable situations include, for example, circuit breakers employed in connection with combat (e.g., in a battleship under wartime conditions), fire-fighting (e.g., energizing pumps for pumping water to fire hoses in a high-rise building), spacecraft launch (e.g., energizing ground-based circuits critical to a safe launch), mining (e.g., energizing pumps employed to rapidly remove water from a flooded mine shaft), or nuclear power generation (e.g., energizing circuits critical to tripping a nuclear reactor). Sce, for example, U.S. Pat. No. 5,831,503. Although most circuit breakers can still trip internally even if the handle is held in the on position, a handle lock to prevent displacement of the circuit breaker handle would preclude manual operation that might inadvertently remove power in a critical situation.

U.S. Pat. Nos. 2,849,552; 3,214,530; 3,408,466; 4,347,412; 5,147,991; 5,219,070; 5,310,969; 5,412,167; 5,500,495; 5,577,599; and 5,732,815 disclose handle locking mechanisms consisting of an assembly of at least two parts and each employs a padlock to lock the handle of the circuit breaker in a fixed position. There are several disadvantages associated with known handle locking mechanisms of this type.

Many known locking mechanisms of this type employ a set or Allen screw to engage the circuit breaker handle, in order to prohibit its movement. See, e.g., U.S. Pat. Nos. 2,849,552; 5,147,991; 5,500,495; and 5,732,815. Construction of the locking mechanisms is typically complex and often comprises numerous, separate parts. Generally, the locking mechanisms are not integrated with the circuit breaker, thereby being susceptible to loss of one or more pieces when not in use. Applicability is often limited to a certain type of circuit breaker or a select type or shape of circuit breaker handle and modification to the circuit breaker handle and/or the circuit breaker housing is frequently required. See, e.g., U.S. Pat. Nos. 4,347,412; 3,408,466; 5,219,070; and 5,412,167. Many known locking mechanisms of this type also employ at least one nose, wedge, end part, leg or similar structure adapted for insertion within the handle opening of the circuit breaker housing, for example, between the circuit breaker handle and the end wall of the handle opening, to abut, underlie or otherwise engage the end wall, in order to resist movement of the circuit breaker handle. See, e.g., U.S. Pat. Nos. 2,849,552; 3,408,466; 4,347,412; 5,412,167; 5,500,495; and 5,732,815.

There is a need, therefore, for a simplified locking assembly for electrical switching apparatus that requires no modification or invasive engagement of the electrical switching apparatus handle or housing.

Accordingly, there is room for improvement in locking assemblies for electrical switching apparatus.

SUMMARY OF THE INVENTION

These needs and others are satisfied by the present invention, which is directed to a locking assembly for an electrical switching apparatus. The locking assembly engages an elevated portion of the apparatus housing in order to restrain movement of the operating handle. The locking assembly may employ a wide variety of user supplied locks to restrain movement of the operating handle.

As one aspect of the invention, a locking assembly is used with an electrical switching apparatus, which includes a housing with an opening and an operating handle protruding from the opening, the locking assembly comprises: a first locking element pivotally connected to and extending away from the operating handle in a first direction, in order to engage a portion of the housing, the first locking element including a first aperture extending therethrough; a second locking element pivotally connected to and extending away from the operating handle in a second direction opposite the first direction of the first locking element, in order to engage another portion of the housing, the second locking element including a second aperture extending therethrough, the second aperture corresponding to the first aperture of the first locking element; and a lock extending through the first and second apertures, in order to lock the first and second locking elements, respectively, thereby restraining movement of the operating handle.

As another aspect of the invention, a locking assembly is used with an electrical switching apparatus, which includes a housing with an elevated portion having a top, two sides, opposing first and second edges and an opening, the opening including a first end and a second end, the electrical switching apparatus also including an operating handle protruding from the opening, the operating handle moving between a first position proximate the first end of the opening and a second position proximate the second end of the opening, the locking assembly comprises: a lock having a shackle; a first locking element including at least one first aperture receiving the shackle of the lock, the first locking element structured to engage one of the opposing first and second edges of the elevated portion of the housing, in order to restrain movement of the operating handle; a second locking element including at least one second aperture corresponding to the at least one first aperture of the first locking element, the second locking element being structured to engage at least a portion of the top of the elevated portion of the housing, in order to further restrain movement of the operating handle; and means for pivotally connecting each of the first and second locking elements to the operating handle.

The first locking element may have an L-shape corresponding to at least a portion of the elevated portion of the housing. The L-shaped first locking element may include a first portion with an edge-engaging portion structured to engage a corresponding one of the opposing first and second edges of the elevated portion of the housing.

The first locking element may have a T-shape with a portion thereof corresponding to at least a portion of the elevated portion of the housing. The T-shaped first locking element may include symmetrical first and second edge-engaging portions each of which is structured to engage a corresponding one of the opposing first and second edges of the elevated portion of the housing.

The T-shaped locking element may be adapted to pivot between a first locked position and a second locked position, in order to restrain movement of the operating handle between the first position and the second position, respectively, of the operating handle.

As another aspect of the invention, an electrical switching apparatus comprises: a housing including at least one elevated portion having a top, two sides, opposing first and second edges and at least one opening, the at least one opening having a first end and a second end; at least one pair of separable contacts; an operating mechanism including at least one operating handle structured to open and close the separable contacts, each of the at least one operating handle protruding from a corresponding one of the at least one opening of the at least one elevated portion of the housing and moving between a first position proximate the first end of the corresponding one of the at least one opening and a second position proximate the second end of the corresponding one of the at least one opening; and an integral locking assembly comprising: a lock having a shackle; a first locking element including at least one first aperture receiving the shackle of the lock when the first locking element engages a corresponding one of the opposing first and second edges of at least one of the at least one elevated portion of the housing, in order to restrain movement of the at least one operating handle; a second locking element including at least one second aperture corresponding to the at least one first aperture of the first locking element and receiving the shackle of the lock when the second locking element engages at least a portion of the top of at least one of the at least one elevated portion of the housing, in order to further restrain movement of the at least one operating handle; and means for pivotally connecting each of the first and second locking elements to at least one of the at least one operating handle.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

For purposes of illustration, the invention will be described as applied to a circuit breaker, although it will become apparent that it could also be applied to other types of electrical switching apparatus (e.g., without limitation, circuit switching devices and other circuit interrupters such as contactors, motor starters, motor controllers and other load controllers).

Figure 1:
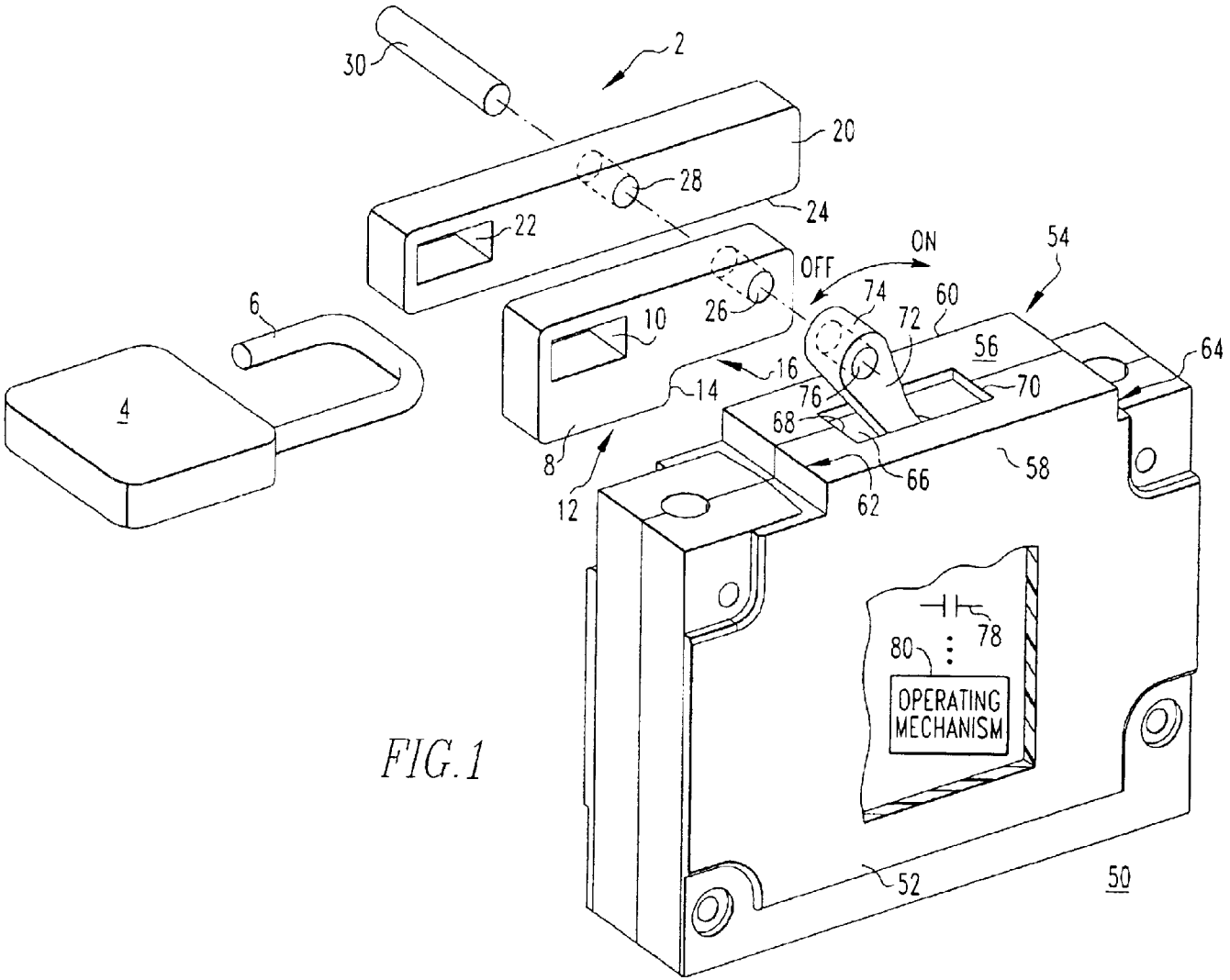
FIG. 1 is an exploded, isometric view of a switch locking assembly in accordance with the present invention and an associated circuit breaker, with the circuit breaker housing partially cut-away to show internal structures.

FIG. 1 shows a locking assembly 2 for use with electrical switching apparatus such as, for example, the exemplary circuit breaker 50. As shown, the basic components of the circuit breaker 50 include a housing 52 with an elevated portion 54 having a top 56, two sides 58,60, opposing first and second edges 62,64 and an opening 66. The opening 66 includes a first end 68 and a second end 70. An operating handle 72 protrudes from the opening 66. The operating handle 72 moves between a first position proximate the first end 68 of the opening 66 and a second position proximate the second end 70 of the opening 66. The housing 52 encloses separable contacts 78 and an operating mechanism 80 which opens and closes the separable contacts 78. The first position of the operating handle 72 corresponds to an "off" position in which the separable contacts 78 are open. The second position of the operating handle 72 corresponds to an "on" position in which the separable contacts 78 are closed.

Continuing to refer to FIG. 1, the locking assembly 2 includes a first locking element 8 including at least one first aperture 10 (only one aperture is shown in FIG. 1). The first aperture 10 is structured to receive, for example, the shackle 6 of a lock 4, as shown. The first locking element 8 is structured to engage one of the opposing first and second edges 62,64 of the elevated portion 54 of the housing 52, in order to restrain movement of the operating handle 72.

As shown, the exemplary first locking element 8 has an L-shape including a first portion 12 and a relatively longer second portion 16 extending perpendicularly from the first portion 12. The first portion 12 includes an edge-engaging portion 14 structured to engage a corresponding one of the opposing first and second edges 62,64 of the elevated portion 54 of the housing 52.

The locking assembly 2 further includes a second locking element 20 including at least one second aperture 22 (only one aperture is shown in FIG. 1) corresponding to the first aperture 10 of the first locking element 8. The second locking element 20 includes a top engaging portion 24 structured to engage a corresponding portion of the top 56 of the elevated portion 54 of the housing 52 in order to further restrain movement of the operating handle 72. As shown, each of the first and second locking elements 8,20 further includes a fourth aperture 26,28, respectively, corresponding to a third aperture 76 in the external end 74 of the operating handle 72. A pivot member 30 extends through the fourth apertures 26,28 and through the third aperture 76, in order to pivotally connect the first and second locking elements 8,20 to the operating handle 72.

Figure 2:
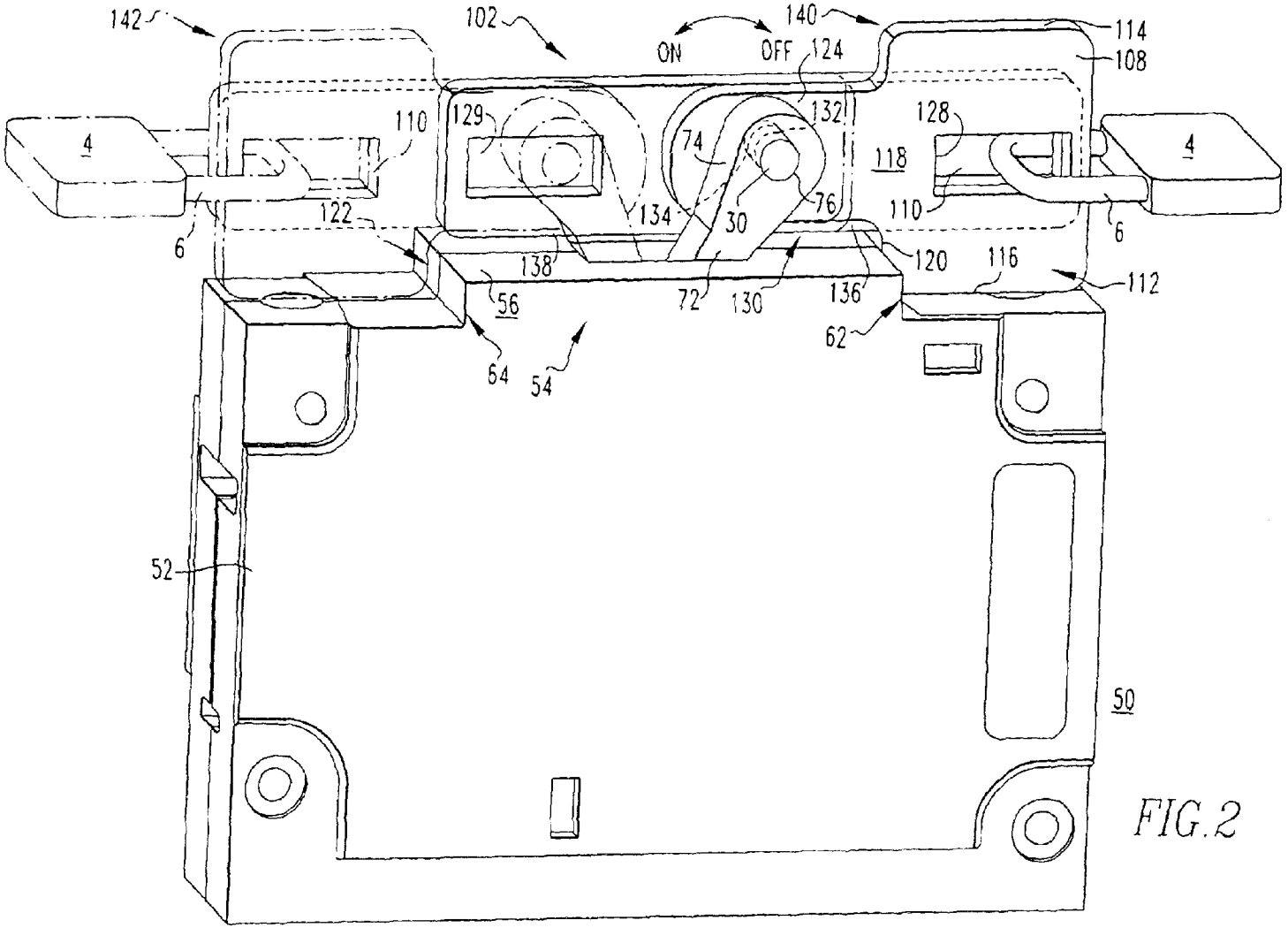
FIG. 2 is an isometric view of a single-pole circuit breaker and a locking assembly in accordance with another embodiment of the invention.

FIG. 2 illustrates an embodiment of a locking assembly 102 in which a first locking element is a T-shaped locking element 108. The T-shaped first locking element 108 includes a first portion 112 and a relatively longer section portion 124. The first portion 112 has two ends 114,116 and an intermediate region 118. The longer second portion 124 extends perpendicularly from the intermediate region 118 of the first portion 112, in order to separate the first portion 112 into symmetrical first and second edge-engaging portions 120,122 each of which is structured to engage a corresponding one of the opposing first and second edges 62,64 of the elevated portion 54 of the housing 52 of the circuit breaker 50 of FIGS. 1 and 2.

The T-shaped first locking element 108 is adapted to pivot between a first locked position 140 corresponding to the "off" position of the operating handle 72 and a second locked position 142 (shown in phantom line drawing) corresponding to the "on" position of the circuit breaker operating handle 72. As shown, first and second gaps 136,138 may be optionally provided between the longer second portion 124 of the T-shaped first locking element 108 and the top 56 of the elevated portion 54 of the housing 52 when the symmetrical first and second edge-engaging portions 120, 122 engage the corresponding opposing first and second edges 62,64, respectively, of the elevated portion 54 of the housing 52.

Continuing to refer to FIG. 2, the exemplary second locking element 126 is structured to correspond with each of the longer second portion 124 of the T-shaped first locking element 108 and the top 56 of the elevated portion 54 of the housing 52. The second locking element 126 includes a top engaging portion 130 structured to engage a corresponding portion of the top 56 of the elevated portion 54 of the housing 52, in order to further restrain movement of the operating handle 72.

The exemplary first aperture 110 of the T-shaped first locking element 108 receives the shackle 6 of the lock 4. The second locking element 126 includes corresponding first and second shackle-receiving apertures 128,129. However, it will be appreciated that both the first and second locking elements 108,126 may have any number of apertures having a variety of shapes structured to receive a variety of different locking elements, such as, for example, the exemplary shackle 6 of lock 4.

In use, the locking assembly 102 may lock the circuit breaker 50 in the first locked position 140, or "off" position, in which the shackle-receiving aperture 110 of the T-shaped first locking element 108 corresponds with the first shackle-receiving aperture 128 of the second locking element 126 in order to receive the shackle 6 of the lock 4, when the first edge-engaging portion 120 of the T-shaped first locking element 108 engages the corresponding first edge 62 of the elevated portion 54 of the housing 52, and, the top engaging portion 130 of the second locking element 126 simultaneously engages a corresponding portion of the top 56 of the elevated portion 54 of the housing 52. Alternatively, if a user desires to lock the circuit breaker operating handle 72 in the "on" position, the T-shaped first locking element 108 is pivoted to the second locked position 142 (shown in phantom line drawing), in which the shackle-receiving aperture 110 of the T-shaped first locking element 108 corresponds with the second shackle-receiving aperture 129 of the second locking element 126, in order to receive the shackle 6 of the lock 4 when the second edge-engaging portion 122 of the T-shaped locking element 108 engages the corresponding second edge 64 of the elevated portion 54 of the housing 52, and, the top engaging portion 130 of the second locking element 126 simultaneously engages a corresponding portion of the top 56 of the elevated portion 54 of the housing 52.

As discussed above, the first and second locking elements 108,126 are pivotally connected to the operating handle 72 by a pivot member 30 extending through fourth apertures 132,134 in the first and second locking elements 108,126, respectively, and through the third aperture 76 of the external end 74 of the operating handle 72. However, it will be appreciated that any suitable pivotal connecting mechanism (not shown), other than the exemplary pivot member 30, could be employed to pivotally connect first and second locking elements, (e.g., 108,126) to an operating handle (e.g., 72).

It will also be appreciated that any suitable locking clement (e.g., without limitation, a dowel, a pin, a wire or any other suitable insert) (not shown) may be inserted through shackle-receiving apertures (e.g., 110,128 of first and second locking elements (e.g., 108,126), in order to restrain movement of a circuit breaker operating handle (e.g., 72) instead of the exemplary lock shackle 6. As another possible alternative, for example, without limitation, wire (not shown) could be inserted through shackle-receiving apertures (e.g., 110,128) and sealed (not shown). The sealed wire locking mechanism (not shown) would prevent unauthorized manipulation of the circuit breaker operating handle 72 without first cutting the wire (not shown). It will be appreciated that these and any other suitable locking mechanisms (not shown), in addition to the exemplary lock 4 and shackle 6, could be employed to lock a locking assembly (e.g., 102), thereby restraining movement of an operating handle (e.g., 72).

Figure 3:
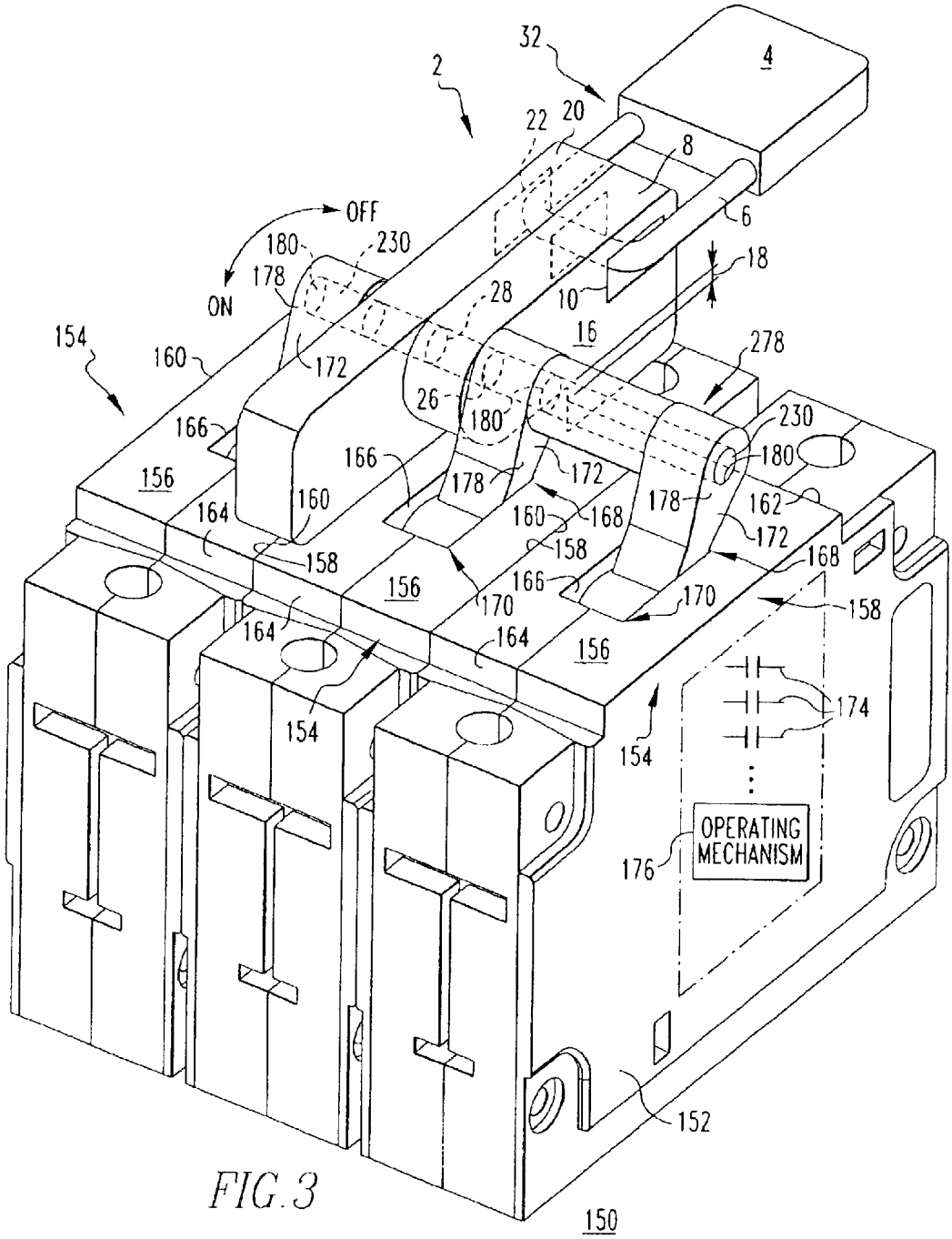
FIG. 3 is an isometric view of the locking assembly of FIG. 1 engaging a ganged operating handle of a three-pole circuit breaker in accordance with another embodiment of the invention, with the circuit breaker housing partially cut-away to show internal structures.
Figure 4:
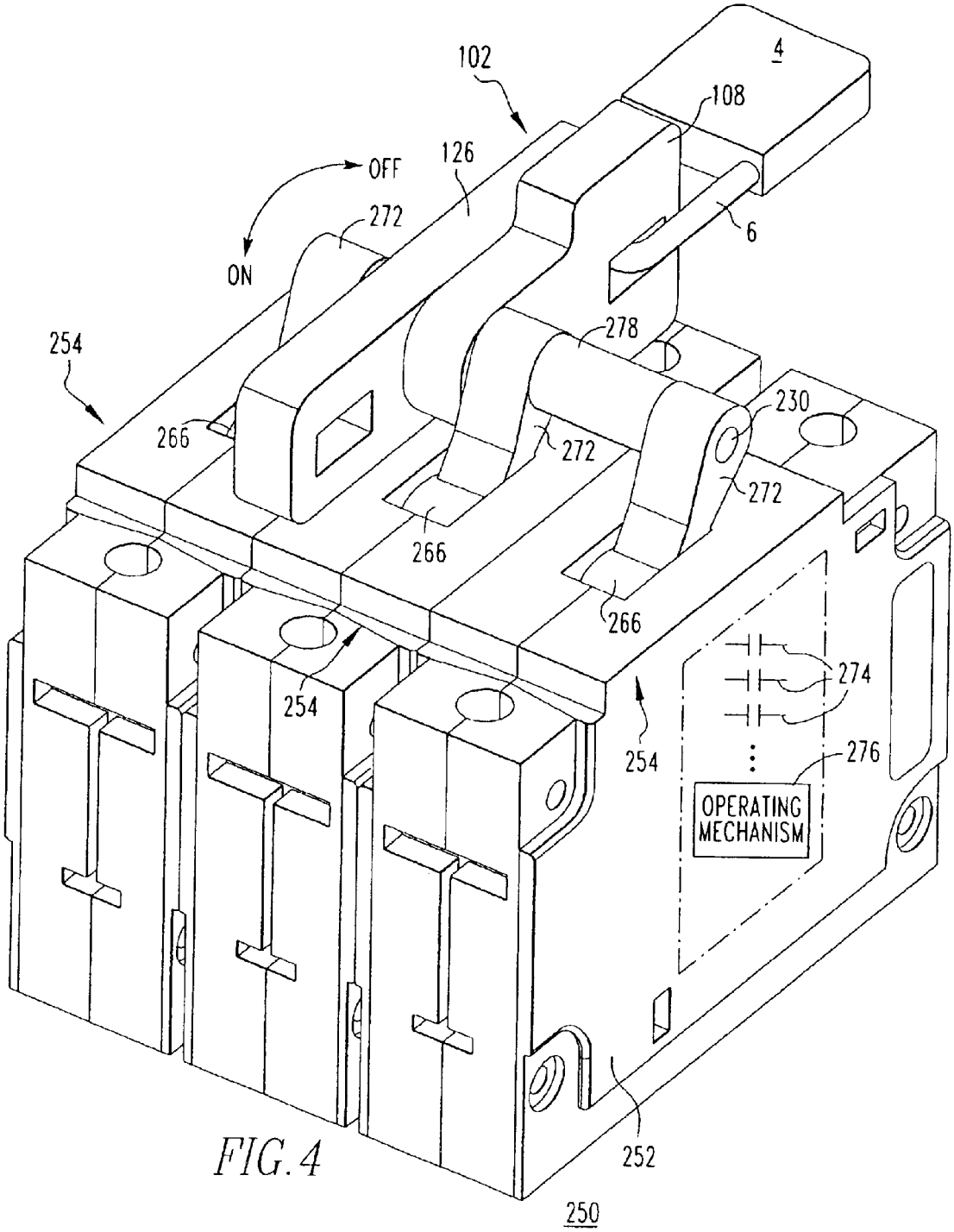
FIG. 4 is an isometric view of a three-pole circuit breaker, with the circuit breaker housing partially cut-away to show internal structures, and a locking assembly in accordance with another embodiment of the invention.
Figure 5:
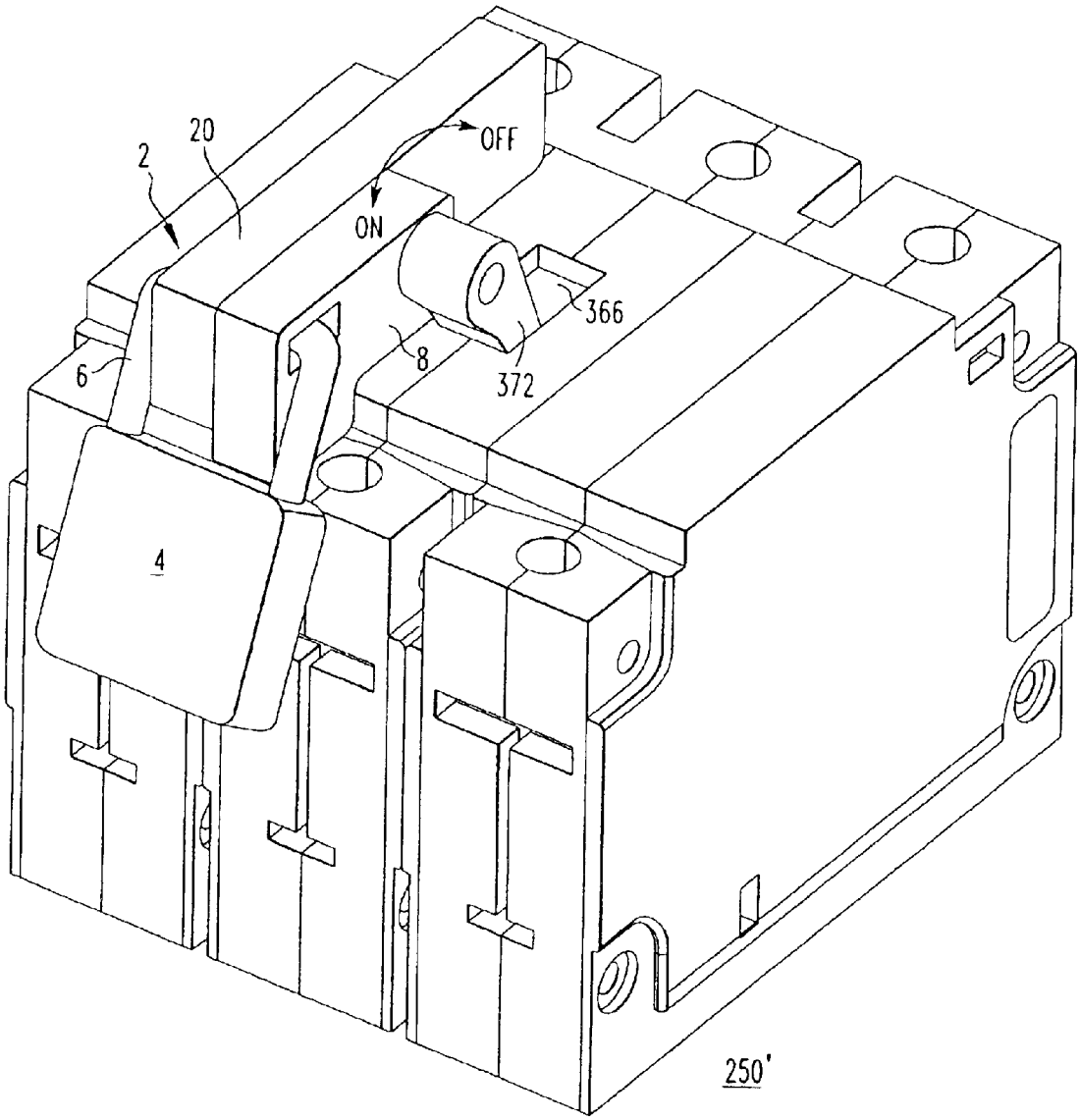
FIG. 5 is an isometric view of the locking assembly of FIG. 1 as employed on a three-pole circuit breaker in accordance with another embodiment of the invention.

The locking assembly 2 of FIG. 1 may be employed in a variety of applications in connection with a wide range of electrical switching apparatus. Three such example applications are shown in FIGS. 3, 4 and 5. FIG. 3 shows an example of the locking assembly 2 as employed on a multi-pole circuit breaker 150 (a three-pole circuit breaker is shown in FIG. 3) including a housing 152 having at least one elevated portion 154 (three are shown in FIG. 3) each having a top 156, two sides 158,160, opposing first and second edges 162,164 and at least one opening 166 (three are shown in FIG. 3). Each opening 166 has a first end 168 and a second end 170. The housing 152 encloses at least one pair of separable contacts 174 (three pairs are shown in FIG. 3) and an operating mechanism 176 including at least one operating handle 172 (three are shown in FIG. 3) structured to open and close the separable contacts 174. As shown, each operating handle 172 protrudes from a corresponding one of the openings 166 of the elevated portions 154 of the housing 152 and moves between a first position proximate the first end 168 of the corresponding opening 166, corresponding to the "off" position of the circuit breaker handle 172 and a second position proximate the second end 170 of the corresponding opening 166, corresponding to the "on" position of the circuit breaker handle 172.

Continuing to refer to FIG. 3, a pivot member 230 extends through the fourth apertures 26,28 of the first and second locking elements 8,20, respectively, and the third aperture 180 of the external end 178 of at least one of the operating handles 172. As shown, the exemplary pivot member 230 extends through the third aperture 180 in the external end 178 of all three operating handles 172, in order to form a single ganged operating handle 278.

For illustrative purposes, the locking assembly 2 is shown with the lock 4 disposed in the locked position 32. When disposed in the locked position 32, the shackle 6 of the lock 4 is inserted through the first and second apertures 10,22 of the first and second locking elements 8,20, respectively, thereby preventing unauthorized operation of the ganged operating handle 278. As shown, the L-shaped first locking element 8 may optionally include a gap 18 between the relatively longer portion 16 of the L-shaped first locking element 8 and the top 156 of the elevated portion 154 of the circuit breaker housing 152.

As discussed above, it will be appreciated that both the locking assembly 2 employing the L-shaped first locking element 8 (FIGS. 1, 3 and 5) and the locking assembly 102 employing the T-shaped locking element 108 (FIGS. 2 and 4) may be employed to lock a variety of electrical switching apparatus. It will also be appreciated that either locking assembly 2 or 102 may be pivotally attached to any combination of operating handles (e.g., 172 of FIG. 3 or 272 of FIG. 4), in order to restrain movement thereof, from the "off" or "on" positions, according to user preference. It will further be appreciated that the locking assembly 2 can be employed on a circuit breaker having any number of poles, with any number of openings, and any number of operating handles (not shown). Additionally, when used on a multi-pole circuit breaker with a plurality of poles, any combination of one or more locking assemblies 2,102 can be placed on any number of operating handles (e.g., 172,272) in a wide array of possible switch position combinations (not shown). For example, on a three-pole circuit breaker with three separate (non-ganged) operating handles (not shown), two locking assemblies could be employed, one locking a first operating handle in the "on" position and another locking a second operating handle in the "off" position, with the third operating handle not using a locking assembly (not shown).

Referring to FIG. 4, the locking assembly 102 may be used to restrain a multi-pole circuit breaker having a housing 252 with a plurality of elevated portions 254 having a plurality of openings 266 through which a plurality of operating handles 272 protrude to open and close a plurality of pairs of separable contacts 274 via an operating mechanism 276. As shown, the exemplary multi-pole circuit breaker is a three-pole circuit breaker 250 having the three operating handles 272 protruding from the three openings 266 in the three elevated portions 254. The three operating handles 272 are linked together to form a single ganged operating handle 278.

For illustrative purposes, the locking assembly 102 is shown as employed between two of the operating handles 272, in order to restrain movement of all three operating handles 272 of the ganged operating handle 278. However, one skilled in the art will appreciate that one or more locking assemblies 102 may be employed in any position with respect to any of the operating handles 272. Additionally, it will be appreciated that either embodiment of the locking assembly 2 or 102 may be employed on a single-pole circuit breaker, on multi-pole circuit breakers having any number of poles, and on any combination of ganged handles or single handles, in a wide variety of configurations (not shown).

FIG. 5 shows an example of the locking assembly 2 as employed on a multi-pole circuit breaker, such as a threepolo circuit breaker 250' including a single opening 366 and a single operating handle 372. For illustrative purposes, the locking assembly 2 is shown as employed to restrain movement of the operating handle 372 from the "on" circuit breaker position.

It will be appreciated that the components of the locking assemblies 2,102 may be made from a wide array of materials, including, without limitation, thermoplastic or springstock material. The locking assemblies 2,102 may also be made using a wide variety of manufacturing processes, including, without limitation, forming, molding or casting.

It will also be appreciated that, while each of the exemplary locking assemblies 2,102 is integrally connected to at least one operating handle (e.g., 372) by a pivot member (e.g., 30 of FIG. 1), the locking assemblies 2,102 may alternatively be readily detachable (not shown) from the operating handle. Additionally, although L-shaped and T-shaped first locking elements 8,108, respectively, are disclosed, it will be appreciated that a wide range of alternative locking element shapes and sizes (not shown) could be employed.

The relatively simplistic and tamper-resistant locking assemblies 2,102 provide a valuable safety feature and added security measure for electrical switching applications where maintaining the switch handle position status is critical. The invention offers simplified locking assemblies 2,102 over the known prior art by eliminating unnecessary, cumbersome parts and replacing complex designs with one that can be readily employed with a variety of switches without requiring modification to the switch handle or electrical switching apparatus housing. The exemplary locking assemblies 2,102 are also an integral part of the circuit breaker, permitting free operation of the switch when not employed while eliminating the possibility of inadvertently losing one or more lock assembly parts. Additionally, as discussed above, the locking assemblies 2,102 may be used with a wide variety of locks (e.g., 4) having a wide variety of shackles (e.g., 6) or other suitable locking mechanisms (not shown).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A locking assembly for use with electrical switching apparatus including a housing with an opening and an operating handle protruding from said opening, said locking assembly comprising:

a first locking element pivotally connected to and extending away from said operating handle in a first direction, in order to engage a portion of said housing, said first locking element including a first aperture extending therethrough;

a second locking element pivotally connected to and extending away from said operating handle in a second direction opposite the first direction of said first locking element, in order to engage another portion of said housing, said second locking element including a second aperture extending therethrough, said second aperture corresponding to the first aperture of said first locking element; and a lock extending through said first and second apertures, in order to lock said first and second locking elements, respectively, thereby restraining movement of said operating handle.

2. A locking assembly for use with electrical switching apparatus including a housing with an elevated portion having a top, two sides, opposing first and second edges and an opening, said opening including a first end and a second end, said electrical switching apparatus also including an operating handle protruding from said opening, said operating handle moving between a first position proximate the first end of said opening and a second position proximate the second end of said opening, said locking assembly comprising:

a lock having a shackle;

a first locking element including at least one first aperture receiving the shackle of said lock, said first locking element structured to engage one of said opposing first and second edges of the elevated portion of said housing, in order to restrain movement of said operating handle;

a second locking element including at least one second aperture corresponding to the at least one first aperture of said first locking element, said second locking element being structured to engage at least a portion of the top of the elevated portion of said housing, in order to further restrain movement of said operating handle; and means for pivotally connecting each of said first and second locking elements to said operating handle.

3. The locking assembly of claim 2 wherein said lock has a locked position; and wherein said lock is disposed in said locked position when the shackle of said lock is inserted through said first and second apertures of said first and second locking elements, respectively, thereby preventing unauthorized operation of said operating handle.

4. The locking assembly of claim 2 wherein said operating handle has an external end with a third aperture extending therethrough; wherein each of said first and second locking elements further includes a fourth aperture corresponding to said third aperture; and wherein said means for pivotally connecting is a pivot member extending through the fourth apertures and structured to extend through the third aperture, in order to pivotally connect said first and second locking elements to said operating handle.

5. The locking assembly of claim 2 wherein said first locking element has an L-shape corresponding to at least a portion of the elevated portion of said housing.

6. The locking assembly of claim 5 wherein said L-shaped first locking element includes a first portion and a longer second portion extending perpendicularly from said first portion; and wherein said first portion includes an edge-engaging portion structured to engage a corresponding one of said opposing first and second edges of the elevated portion of said housing.

7. The locking assembly of claim 6 wherein the longer second portion of said L-shaped first locking element includes a gap between the top of said elevated portion of said housing when said edge-engaging portion engages the corresponding one of said first and second edges of the elevated portion of said housing.

8. The locking assembly of claim 6 wherein said second locking element is structured to correspond with at least a portion of each of the longer second portion of said L-shaped first locking element and the top of the elevated portion of said housing; and wherein said second locking element further includes a top-engaging portion structured to engage a corresponding portion of the top of the elevated portion of said housing.

9. The locking assembly of claim 2 wherein said first locking element has a T-shape with a portion thereof corresponding to at least a portion of the elevated portion of said housing.

10. The locking assembly of claim 9 wherein said T-shaped first locking element includes a first portion and a longer second portion; wherein said first portion has two ends and an intermediate region; wherein said longer second portion extends perpendicularly from the intermediate region of said first portion, in order to separate said first portion into symmetrical first and second edge-engaging portions each of which is structured to engage a corresponding one of said opposing first and second edges of the elevated portion of said housing.

11. The locking assembly of claim 10 wherein the longer second portion of said T-shaped first locking element includes first and second gaps between the top of the elevated portion of said housing when said symmetrical first and second edge-engaging portions engage the corresponding opposing first and second edges, respectively, of the elevated portion of said housing.

12. The locking assembly of claim 10 wherein said second locking element is structured to correspond with each of the longer second portion of said T-shaped first locking element and the top of the elevated portion of said housing; and wherein said second locking element further includes a top-engaging portion structured to engage a corresponding portion of the top of the elevated portion of said housing.

13. The locking assembly of claim 12 wherein said T-shaped first locking element is adapted to rotate between a first locked position and a second locked position, in order to restrain movement of said operating handle between the first position and the second position, respectively, of said operating handle.

14. The locking assembly of claim 13 wherein said at least one first aperture of said T-shaped first locking element is a shackle-receiving aperture; wherein said corresponding at least one second aperture of said second locking element includes corresponding first and second shackle-receiving apertures; wherein the shackle-receiving aperture of said T-shaped first locking element corresponds with the first shackle-receiving aperture of said second locking element when said first edge-engaging portion of said T-shaped first locking element engages the corresponding first edge of the elevated portion of said housing, and, said top-engaging portion of said second locking element simultaneously engages a corresponding portion of the top of the elevated portion of said housing, respectively, in order to receive the shackle of said lock and restrain movement of said operating handle from said first locked position; and wherein the shackle-receiving aperture of said T-shaped first locking element corresponds with the second shackle-receiving aperture of said second locking element when said second edge-engaging portion of said T-shaped first locking element engages the corresponding second edge of the elevated portion of said housing, and, said top-engaging portion of said second locking element simultaneously engages a corresponding portion of the top of the elevated portion of said housing, respectively, in order to receive the shackle of said lock and restrain movement of said operating handle from said second locked position.

15. An electrical switching apparatus comprising:

a housing including at least one elevated portion having a top, two sides, opposing first and second edges and at least one opening, said at least one opening having a first end and a second end;

at least one pair of separable contacts;

an operating mechanism including at least one operating handle structured to open and close said separable contacts, each of said at least one operating handle protruding from a corresponding one of said at least one opening of said at least one elevated portion of said housing and moving between a first position proximate the first end of said corresponding one of said at least one opening and a second position proximate the second end of said corresponding one of said at least one opening; and an integral locking assembly comprising:

a lock having a shackle;

a first locking element including at least one first aperture receiving the shackle of said lock when said first locking element engages a corresponding one of said opposing first and second edges of at least one of said at least one elevated portion of said housing, in order to restrain movement of said at least one operating handle;

a second locking element including at least one second aperture corresponding to the at least one first aperture of said first locking element and receiving the shackle of said lock when said second locking element engages at least a portion of the top of at least one of said at least one elevated portion of said housing, in order to further restrain movement of said at least one operating handle; and means for pivotally connecting each of said first and second locking elements to at least one of said at least one operating handle.

16. The electrical switching apparatus of claim 15 wherein each of said at least one operating handle has an external end with a third aperture extending therethrough; wherein each of said first and second locking elements further includes an fourth aperture corresponding to said third aperture; and wherein said means for pivotally connecting is a pivot member extending through the fourth apertures and structured to extend through the third aperture, in order to pivotally connect said first and second locking elements to at least one of said at least one operating handle.

17. The electrical switching apparatus of claim 15 wherein said first locking element has an L-shape including a first portion and a longer second portion extending perpendicularly from said first portion; wherein said first portion includes an edge-engaging portion engaging a corresponding one of said opposing first and second edges of at least one of the at least one elevated portion of said housing; and wherein said second locking element includes a top-engaging portion engaging a corresponding portion of the top of at least one of the at least one elevated portion of said housing.

18. The electrical switching apparatus of claim 15 wherein said first locking element has a T-shape including a first portion and a longer second portion; wherein said first portion has two ends and an intermediate region, wherein said longer second portion extends perpendicularly from the intermediate region of said short portion, in order to separate said first portion into symmetrical first and second edge-engaging portions each of which is structured to engage a corresponding one of said opposing first and second edges of at least one of the at least one elevated portion of said housing; and wherein said second locking element includes a top-engaging portion structured to engage a corresponding portion of the top of at least one of the at least one elevated portion of said housing.

19. The electrical switching apparatus of claim 18 wherein said T-shaped first locking element pivots between a first locked position and a second locked position, in order to restrain movement of at least one of said at least one operating handle between the first position and the second position, respectively, of said at least one of said at least one operating handle; wherein said at least one first aperture of said T-shaped first locking element is a shackle-receiving aperture; wherein said corresponding at least one second aperture of said second locking element includes corresponding first and second shackle-receiving apertures; wherein the shackle-receiving aperture of said T-shaped first locking element corresponds with the first shackle-receiving aperture of said second locking element when said first edge-engaging portion of said T-shaped first locking element engages the corresponding first edge of at least one of the at least one elevated portion of said housing, and, said top-engaging portion of said second locking element simultaneously engages a corresponding portion of the top of at least one of the at least one elevated portion of said housing, respectively, in order to receive the shackle of said lock and restrain movement of said at least one operating handle from said first locked position; and wherein the shackle-receiving aperture of said T-shaped first locking element corresponds with the second shackle-receiving aperture of said second locking element when said second edge-engaging portion of said T-shaped first locking element engages the corresponding second edge of at least one of the at least one elevated portion of said housing, and, said top-engaging portion of said second locking element simultaneously engages a corresponding portion of the top of at least one of the at least one elevated portion of said housing, respectively, in order to receive the shackle of said lock and restrain movement of said at least one operating handle from said second locked position.

20. The electrical switching apparatus of claim 15 wherein said electrical switching apparatus is a single-pole circuit breaker; wherein said at least one elevated portion is an elevated portion; wherein said at least one opening is an opening; wherein said at least one pair of separable contacts is a pair of separable contacts; and wherein said at least one operating handle is an operating handle.

21. The electrical switching apparatus of claim 15 wherein said electrical switching apparatus is a multi-pole circuit breaker, wherein said at least one opening is a plurality of openings; wherein said at least one elevated portion is a plurality of elevated portions; wherein said at least one pair of separable contacts is a plurality of pairs of separable contacts; and wherein said at least one operating handle is a plurality of operating handles.

22. The electrical switching apparatus of claim 21 wherein said means for pivotally connecting is a pivot member connecting each of said operating handles to form a single ganged operating handle.

23. The electrical switching apparatus of claim 15 wherein said electrical switching apparatus is a three-pole circuit breaker; wherein said at least one opening is an opening; and wherein said at least one operating handle is an operating handle.

* * * * *